US005707324A

United States Patent [19]

Blake

[11] Patent Number: 5,707,324

[45] Date of Patent: Jan. 13, 1998

[54] PORTABLE GYM

[76] Inventor: Ricky Sam Blake, 3873 Oak Haven Rd., Hope Mills, N.C. 28348

[21] Appl. No.: 756,824

[22] Filed: Nov. 26, 1996

[51] Int. Cl.[6] ..... A63B 21/02

[52] U.S. Cl. ..... 482/124; 422/121; 422/125

[58] Field of Search ..... 482/121, 122, 482/124, 125, 126

[56] References Cited

U.S. PATENT DOCUMENTS

| | | | |
|---|---|---|---|
| 4,955,608 | 9/1990 | Doughery et al. | 482/124 |
| 5,129,647 | 7/1992 | Castellanos . | |
| 5,186,701 | 2/1993 | Wilkinson | 482/124 |
| 5,203,754 | 4/1993 | Maclean | 482/124 |
| 5,207,627 | 5/1993 | Doran | 482/124 |
| 5,328,433 | 7/1994 | Berman . | |
| 5,433,688 | 7/1995 | Davies . | |
| 5,476,435 | 12/1995 | Nimmo . | |
| 5,484,366 | 1/1996 | Wilkinson | 482/124 |

*Primary Examiner*—Lynne A. Reichard
*Attorney, Agent, or Firm*—Joseph H. McGlynn; Patent & Trademark Services, Inc.

[57] ABSTRACT

A belt that can be worn around a person's waist and which has a back support along a portion of the belt. The belt contains loops positioned along the sides of the belt to attach various elastic resistance elements for exercising a person's arms and legs.

4 Claims, 1 Drawing Sheet

FIG. 1
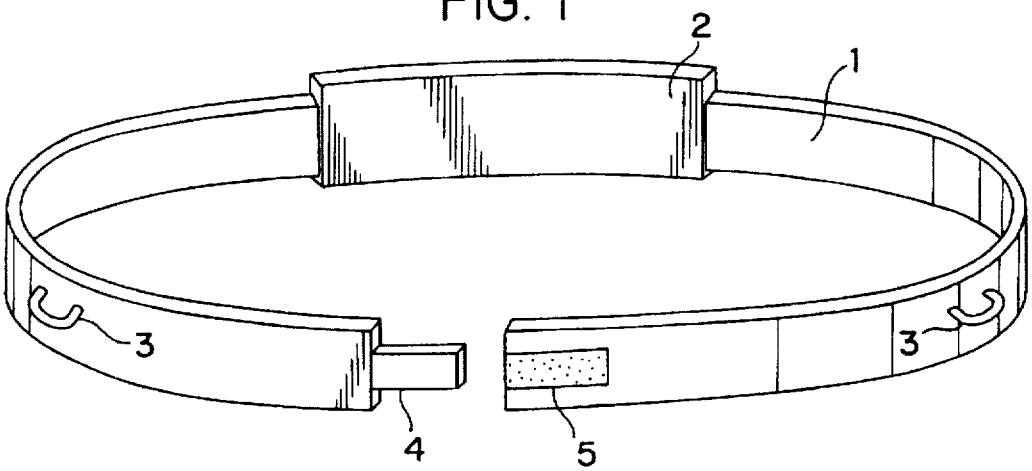
FIG. 2
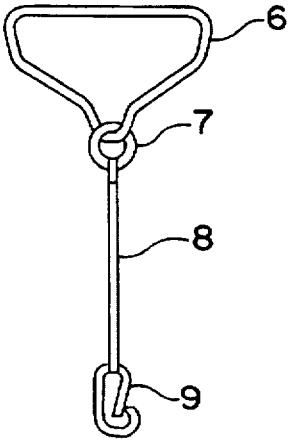
FIG. 3
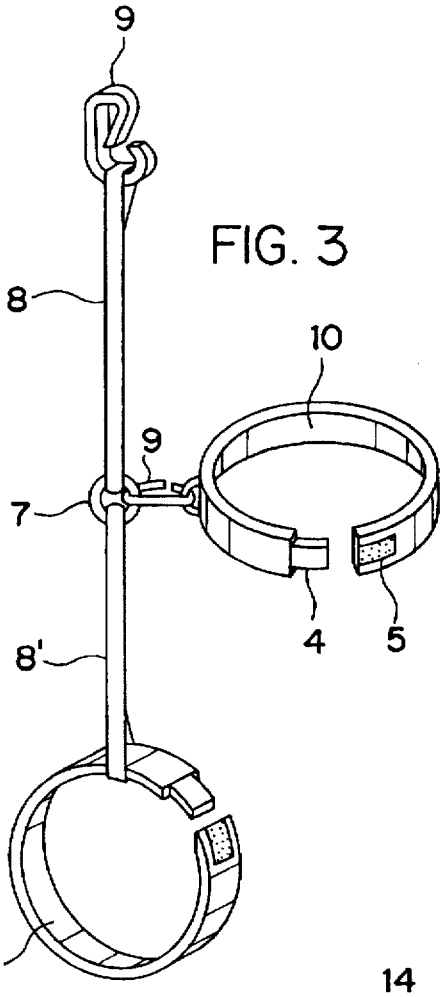
FIG. 4
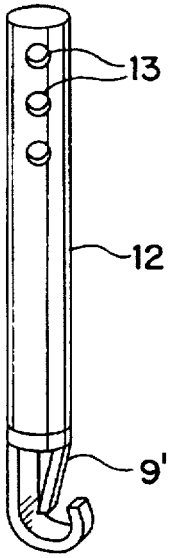
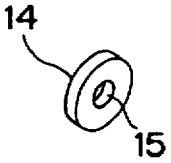
FIG. 5

PORTABLE GYM

BACKGROUND OF THE INVENTION

This invention relates, in general, to exercise devices, and, in particular, to exercise devices which may be worn about a person's waist and used to exercise a person's arms and legs.

DESCRIPTION OF THE PRIOR ART

In the prior art various types of exercise devices have been proposed. For example, U.S. Pat. No. 5,129,647 discloses an exercise device that can be worn around a person's waist and has attachment means for attaching elastic resistance elements to the belt in order to exercise a person's arms.

U.S. Pat. No. 5,328,433 discloses an exercise device with an adjustable resistance which includes a spring and a means fro adjusting the compression of the spring to vary the resistance of the spring.

U.S. Pat. No. 5,433,688 discloses an exercise device worn around a person's waist and is used for exercising a person's upper body through the use of elastic cords.

U.S. Pat. No. 5,476,435 discloses an exercise device which can be worn around a person's waist and has a spring surrounding a rod which telescopes within a cylinder to provide resistance for exercising.

SUMMARY OF THE INVENTION

The present invention comprises a belt that can be worn around a person's waist and which has a back support along a portion of the belt. The belt contains loops positioned along the sides of the belt to attach various elastic resistance elements for exercising a person's arms and legs.

It is an object of the present invention to provide a new and improved exercise device.

It is an object of the present invention to provide a new and improved exercise device which uses elastic resistance elements.

It is an object of the present invention to provide a new and improved exercise device which can be used to exercise a variety of body parts while at the same time protecting a person's back.

These and other objects and advantages of the present invention will be fully apparent from the following description, when taken in connection with the annexed drawings.

BRIEF DESCRIPTION OF THE DRAWINGS

FIG. 1 is a perspective view of the belt of the present invention.

FIG. 2 is a view of one of the resistance elements used with the present invention.

FIG. 3 is a view of another of the resistance elements used with the present invention.

FIG. 4 is a view of another of the resistance elements used with the present invention.

FIG. 5 is a view of a protective element used the resistance element of FIG. 4.

DESCRIPTION OF THE PREFERRED EMBODIMENT

Referring now to the drawings in greater detail, FIG. 1 shows a belt 1 which is used to attach the various resistance elements shown in FIG. 2–4. The belt can be made from a variety of materials, however Nylon is the preferred material since it can easily be formed into the desired shape and can be easily cleaned. At the front of the belt is a fastener 4, 5 which can be used to fasten the belt 1 about a user's waist. It should be noted that while Velcro hook and loop fasteners 4, 5 are shown in the drawings, the invention is not limited to only this type of fastener. Any fastener such as, but not limited to, snaps or a buckle can be used to secure the ends of the belt around a person's waist.

Secured to the back of the belt 1 is an enlarged pad portion 2 which will be placed at the small of the user's back in order to support that part of an exerciser's anatomy while they are using the invention. The pad 2 can be a unitary part of the belt and formed at the same time as the rest of the belt is formed, or it can be a separate piece with a hollow interior that can be slid over the belt before the belt is fastened around the user's waist. If the pad 2 is a separate piece it can be placed on the belt in different positions for different user's and, thereby provide a universal support for all users.

Secured to the sides of the belt 1 are at least two loops 3 which can be made form metal or plastic and secured to the sides of the belts by any conventional means. It should be noted that while only two rings or loops 3 are shown in the drawings, more rings could be attached to the belt to provide multiple attachments points if so desired.

Attached to the rings or loops 3 can be a variety of resistance devices such as the devices shown in FIGS. 2–4. In FIG. 2 a device for exercising the user's arms. A handle 6 is attached at one end of a piece of rubber tubing 8. The handle can be made from metal or plastic. A ring 7 is attached to the handle by any conventional means and a piece of plastic tubing such as, but not limited to, surgical tubing is attached to the ring 7 by any conventional means. At the opposite end of the tubing is attached a spring snap clip 9 which can be used to attach the device shown in FIG. 2 to the loops or rings 3 on the belt 1.

FIG. 3 shows a second resistance exercise device which can be attached to the loops or rings 3 on the belt 1. The device of FIG. 3 can be attached at the same time as the device of FIG. 2 is attached or it can be attached without the FIG. 2 device, depending on which exercises the user chooses to perform. The device of FIG. 3 has a spring snap clip 9 which can be used to attach the device shown in FIG. 3 to the loops or rings 3 on the belt 1, in the same manner as the FIG. 2 device is attached. The FIG. 3 device differs in that a longer piece of tubing is used so a person can exercise their legs. The tubing 8' can be a single long piece or it can be two pieces as shown in FIG. 3. If the tubing is two pieces, a ring 7 will be attached to the ends of the two pieces of tubing in order to attach other devices such as belt or collar 10. If the tubing is a single piece, the ring 7 would be attached to the approximate midpoint of the tubing.

Attached to the ring 7 is a spring snap clip 9 which is attached to a collar or belt 10 which is similar to the belt I, but smaller. In addition, attached to the end of the tubing 8' is a second collar or belt 11. The collar or belt 10 can be attached to a user's leg around the area of the knee, and the collar or belt 11 can be attached in the area of the user's ankle in order to perform different exercises for the user's legs.

FIG. 4 shows a different elastic resistance device which can be substituted for the devices shown in FIGS. 2 and 3, or it can be used along with the devices shown in FIGS. 2 and 3 to provide additional resistance. The tubing 12 shown in FIG. 4 is a so called "bungee cord" and has a series of apertures 13 positioned at one end of the "bungee cord". At the other end of the "bungee cord" is a spring snap clip 9' similar to the clip 9 shown in FIG. 2, and used in the same way. A spring clip 9 can be attached to one of the holes 13 which would be used to attach a handle similar to the handle 6 in FIG. 2, or a collar or belt similar to 10 or 11 shown in FIG. 3. By placing the clip in the one of the holes 13, the user can vary the amount of resistance provided by the "bungee cord". For example, the hole 13 at the end of the cord will provide less resistance than the hole 13 nearest the clip 9". Therefore, in this manner a user can increase the resistance as he continues his/her exercises and gets stronger, or he/she can increase or decrease the resistance of the "bungee cord" depending on the exercise they are performing, or the body part they are exercising.

The element 14 shown in FIG. 5 is a protection device for the apertures 13 in the "bungee cord" 12. The ring 14, which can be made from plastic or metal, will be placed into one of the apertures 13 and then the spring clip 9 can be passed through the aperture 15 in the ring 14. In this manner the clip will not abrade the "bungee cord" 12 and tend to wear it out.

In addition, the tubes 8 and 8' can be shortened, for example by tying a knot in the tube, to shorten their length and, thereby, increasing the resistance provided by the tubes.

In order to use the exercise device of the present invention, a user would first fasten the belt I around their waist, and then attach a pair of the devices of FIG. 2 to the rings 3. Next a pair of the devices of FIG. 3 would be attached to the rings 3. Next, the user would attach the belt 10 or the belt 11, depending on the type of exercise they will be performing. Then the user could exercise both the upper body using the FIG. 2 device, while exercising their lower body using the FIG. 3 device. In addition, since the belt 1 has the pad 2 positioned at the small of the user's back, he/she would have protection against injury to this part of their body.

Although the No Waist Gym and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. An exercise device comprising:

belt means adapted to be secured around a user's waist, said belt means having a length, a thickness, and a width, said belt having a back support means attached to said belt, said back support means having a width which is larger than said width of said belt, said belt having at least two attachment means, first elastic resistance means secured to each of said at least two attachment means, said first elastic resistance means having a handle means attached at one end, second elastic resistance means secured to each of said at least two attachment means, said second elastic resistance means having a first belt attached at approximately the mid point of said second elastic resistance means, and a second belt attached at an end of said second elastic resistance means, whereby a user can utilize said first elastic resistance means to exercise their upper body and can utilize said second elastic resistance means to exercise their lower body, while said back support means protects said user's back, and wherein said first elastic resistance means has a series of apertures at one end, and a spring clip is attached to one of said aperture, and said spring clip is also attached to said attachment means.

2. The exercise device as claimed in claim 1, wherein said second elastic resistance means has a series of apertures at one end, and a spring clip is attached to one of said aperture, and said spring clip is also attached to said attachment means.

3. The exercise device as claimed in claim 2, wherein a circular disk having an aperture therein is positioned in one of said apertures, and said spring clip is attached to said aperture in said circular disk.

4. The exercise device as claimed in claim 1, wherein a circular disk having an aperture therein is positioned in one of said apertures, and said spring clip is attached to said aperture in said circular disk.

* * * * *